US005304970A

United States Patent [19]

Okamoto et al.

[11] Patent Number: 5,304,970

[45] Date of Patent: Apr. 19, 1994

[54] SEESAW BALANCE TYPE MICROMINIATURE ELECTROMAGNETIC RELAY AND METHOD OF PRODUCING THE SAME

[75] Inventors: Yoshio Okamoto; Takashi Miura; Takanori Tanaka; Ikuhiro Andoh; Hajime Tsuboi; Koji Hanada, all of Kawasaki, Japan

[73] Assignee: Fujitsu Limited, Kawasaki, Japan

[21] Appl. No.: 900,728

[22] Filed: Jun. 18, 1992

[30] Foreign Application Priority Data

Jun. 18, 1991 [JP] Japan ..... 3-145115
Feb. 10, 1992 [JP] Japan ..... 4-023121

[51] Int. Cl.[5] ..... H01H 51/22
[52] U.S. Cl. ..... 335/78; 335/80
[58] Field of Search ..... 335/78-80, 335/124, 128, 131, 132, 130

[56] References Cited

U.S. PATENT DOCUMENTS 4,695,813 9/1987 Nobutoki et al. ..... 335/78

FOREIGN PATENT DOCUMENTS 0197391 2/1991 European Pat. Off. .
61-218025 9/1986 Japan .

*Primary Examiner*—Lincoln Donovan
*Attorney, Agent, or Firm*—Staas & Halsey

[57] ABSTRACT

In a seesaw balance type microminiature electoromagnetic relay including an armature unit composed of two movable contact springs having a pivot arm formed at the center thereof and contacts formed at every end thereof, an armature having a protrusion on the back side for a pivotal movement, and an insert-molded insulator, a substrate unit composed of a common terminal for mounting the pivot arm electrically connected to a common terminal pin, a pair of switching terminals having fixed contacts for connecting the contacts of the springs electrically connected to terminal pins, and an electromagnet unit composed of a yoke, an exciter coil wound thereon, a flat shape permanent magnet provided between both ends of the yoke, and two terminal pins electrically connected to the start and the end of the exciter coil, respectively; a hoop member is formed in an integrated configuration of a plurality of groups by a press blanking procedure, each group including a pair of movable contact springs, two non-magnetizing plates and two connecting bars connecting both ends of the springs and one end of the non-magnetizing plate; the armature is piled on the free edge of the non-magnetizing plate and at least one end thereof is welded; an insulator is formed by an insert-mold procedure to cover the movable contact springs and the armature, and the armature unit is formed by cutting boundary portions between the connecting bars and the movable contact springs and non-magnetizing plate. The pivot arm extended from the center part of the movable contact spring is U-shaped and a positioning member is provided at the free edge thereof or at the common terminal for mounting the pivot arm.

6 Claims, 17 Drawing Sheets

SEESAW BALANCE TYPE MICROMINIATURE ELECTROMAGNETIC RELAY AND METHOD OF PRODUCING THE SAME

BACKGROUND OF THE INVENTION

1) Field of the Invention

The present invention relates to a seesaw balance type microminiature electromagnetic relay to be mounted on an exchanger or the like in a high density assembly and a method of producing the same. More specifically, it relates to a process of forming an armature unit in an integral form of movable contact springs having contact points and an armature operated by the attraction force of a magnet, and the structure of the armature unit.

2) Description of the Related Art

The seesaw balance type electromagnetic relay requires reduced installation and floor space thereby providing an advantage in that the available increase in the amount of circuits per printed circuit plate can facilitate an increase in the number of subscribers.

In such a microminiature type of electromagnetic relay, because very fine-structure parts must be assembled during the production process, a simplification of said structures is now in demand, thereby preventing complex production processes.

FIG. 1 shows an enlarged perspective view of a conventional monostable seesaw balance type microminiature electromagnetic relay. In FIG. 1, the electromagnetic relay 1 is comprised of, in broad classification, a casing 5, an armature unit 8, a substrate unit 9, and an electromagnet unit 10. The armature unit 8 is mounted onto common terminal pins 12 provided on the substrate unit 9, and the electromagnet unit 10 is provided between the armature unit 8 and the substrate unit 9.

The armature unit 8 is comprised of two movable contact springs 2 having protrusions 2*a* formed at the center thereof and contacts 2*b* formed at both respective ends thereof, an armature 6 having a non-magnetizing plate 3 on one end of the bottom face thereof, and a insert-molded insulator 7 having notches 7*b* for exposing the protrusions 2*a* of the movable contact springs 2. Since it is not shown in FIG. 1, the insulator 7 has a recess on a bottom face for exposing the protrusions (not shown) of the armature 6.

The substrate unit 9 is provided therein with a plurality of terminal pins 11 to 13 for connecting the unit externally. Terminal pins 11 and 13 each have a fixed contact 11*a* and 13*a*, and common terminal pins 12 have arc-shape grooves 12*a* and protrusions 12*b* formed at respective both sides of the arc-shape grooves 12*a*.

The electromagnet unit 10 is comprised of a U-shape yoke 14, an exciter coil 15 wound on the yoke 14, and a flat shape permanent magnet 16 that is fixed to join both ends of the yoke 14.

Because the protrusions 2*a* of the movable contact springs 2 engage with the arc-shape grooves 12*a*, the armature unit 8 can be pivotally disposed to the substrate unit 9. The protrusion of the armature 6 contacts a surface of the permanent magnet 16 set so that the non-magnetizing plate 3 confronts one-side end of the yoke 14.

The protrusions 12*b* are formed at both respective sides of the arc-shape grooves 12*a* of the terminal pins 12 to coincide with both respective side walls of the trapezoidal notches of the insulator 7; each pair of protrusions 12*b* being formed as a guide for assembly and settlement of the armature unit 8.

In such an electromagnetic relay 1, switching of the contact points is executed by a pivotal movement in a seesaw manner by varying the magnetic flux by energizing the exciter coil 15.

The operation of the non-magnetizing plate 3 will now be described with reference to FIGS. 2A to 2C.

As described above, the electromagnetic relay 1 is switched by energizing the exciter coil 15, and the presence of a non-excited state and an excited state are illustrated schematically in FIGS. 2B and 2C. FIG. 2B designates a non-excited state or ordinary state and FIG. 2C designates an excited state. The movable contact springs 2 are omitted in FIGS. 2B and 2C.

The seesaw balance type electromagnetic relay 1 has terminal pins on both sides, and the relay in FIG. 2B is open and in FIG. 2C is working.

FIG. 2A is an operational characteristic of the relay where a vertical coordinate represents a force and a horizontal coordinate represents a stroke. Numeral 17 denotes a loaded force characteristic of the armature unit 8; 18 is an attractive force characteristic of the electromagnet for the armature unit 8; the upper portion thereof represents the opening side characteristic, and the lower portion represents the working side characteristic. Here, no problem arises when the exciter coil 15 is excited and switched positively from the state of FIG. 2B. However, the attractive force characteristic 18 provides a disadvantage when switching and releasing the excitation of the exciter coil 15 from a working state shown in FIG. 2C to an opening state by the loaded force of the armature unit.

Assuming that the armature 6 is formed entirely of ordinary metal, the armature 6 is magnetized at the time of working to exhibit the characteristic as shown by dotted line 18*a* and has an attractive force larger than the loaded force, and it becomes impossible to return to the opening state even when the excitation of the exciter coil 15 is released. On the other hand, if a non-magnetizing plate formed of material that cannot be magnetized by the armature 6 is provided, its attractive force exhibits the characteristic as shown by solid line 18*b*, which is shifted by as much as the thickness of the non-magnetizing plate 3, i.e., by stroke A, to thereby be smaller than that of the loaded force 17, and on releasing the excitation of the exciter coil 15 the armature 6 can be returned to the opening state.

For this reason, the non-magnetizing plate 3 is indispensable for the monostable electromagnetic relay, although the non-magnetizing plate 3 is not necessary for the bistable electromagnetic relay.

FIGS. 3A to 3D illustrate the operation of the bistable electromagnetic relay. In the case of the bistable electromagnetic relay, the armature 6 is only switched by energizing the exciter coil 15, and the armature 6 is not returned to the original state before energizing the exciter coil 15 as shown in FIGS. 3A to 3C. FIG. 3A designates a non-excited state and FIG. 3B designates an excited state in which the armature 6 is switched. FIG. 3C designates a non-excited state in which the armature 6 remains in the same position as in FIG. 3B. FIG. 3D designates an excited state in which the armature 6 is switched. The movable contact springs 2 are also omitted in FIGS. 3A to 3D.

A conventional method of producing an electromagnetic relay 1 will be described with reference to FIGS. 4 and 5 as follows.

In FIG. 4, a plurality of movable contact springs 2 are formed by press-blanking a hoop member 21 formed by connecting bars 25. In the hoop member 21, a pair of reinforcement pieces 24 are formed at the outside of a pair of movable contact springs 2 for stiffening the hoop member 21. Further, positioning holes 23 are provided with the same interval on the connecting bars 25.

An armature 6 having a center protrusion 6a is formed independently of the hoop member 21 also by the press blanking procedure. The center protrusion 6a can be formed at the time of the press blanking.

The hoop member 21 of the movable contact springs 2 and armature 6, respectively, separately prepared are covered with an insulator 27 by an insert mold technique to thereby form a unitary shape. More specifically, the hoop member 21 is set in a recess 26 of a die 20 and the position of the hoop member 21 in the recess 26 is defined by holes 23 on the connecting bar 25 and pins provided on the bottom of the recess 26. Usually, the die 20 has several pairs of positioning pins. Then the corresponding number of armatures 6 is set in each of the deep recesses 27. Setting of the hoop member 21 and the armature 6 in the die is executed by an industrial robot.

In this way, the hoop member 21 and the armature 6 are supported in the die 20, and then a melted insulator is allowed to flow into the die 20 to cool and solidify the insulator, thus the hoop member 21 and the armature 6 are formed in an integrated shape as shown in FIG. 5.

Thereafter, a non-magnetizing plate 3 for upgrading an opening characteristic is fixed on one-side end of the armature 6 by welding or the like, and finally the connecting bars 25 of the hoop member 21 are cut off as shown by dotted lines by dicing or the like to complete the armature unit.

In the above-described conventional method of producing the seesaw balance type microminiature electromagnetic relay, on the insert mold operation, the movable contact springs 2 and the armature 6 must be separately supplied to the die 20 by the industrial robot and supported therein, almost at the same time. Accordingly, the structure of the industrial robot becomes complex when simultaneously required to supply movable contact springs 2 and the armature 6. After the movable contact springs 2 and the armature 6 are integrated together by the insert mold procedure, the non-magnetizing plate previously prepared is welded on the one-side end of the armature 6, accordingly, a troublesome processing for mounting such a small non-magnetic plate is required, and automatic operation also requires a complex and expensive industrial robot.

SUMMARY OF THE INVENTION

An object of the present invention is to provide a method of simplifying a production process of the electromagnetic relay by solving the above-described problem.

Another object of the present invention is to provide a seesaw balance type microminiature electromagnetic relay having a sufficient joining force at the welded junction of the pivot arm and the terminal pin to obtain uniform junction intensity and durability for long range use.

According to an aspect of the present invention, there is provided a method of producing an electromagnetic relay comprising an electromagnet composed of a magnetic circuit formed of a yoke wound with a coil and a permanent magnet connected to the yoke, an armature unit composed of an armature with a pivotal movement by the operation of the electromagnet, and movable contact springs having on their ends movable contacts that are formed in a unitary shape with the armature to pivotally move together with the armature, and fixed contacts positioned at positions confronting the movable contacts, a method of producing an electromagnetic relay comprises the steps of: forming a hoop member in which a plurality of movable contact springs are connected by connecting bars and a non-magnetizing plate provided in a unitary form but in a protruding manner from the connecting bars; forming in a unitary shape the hoop member and the armature by fixing the separately prepared armature onto the non-magnetizing plate; forming an insulator by an insert-mold procedure to cover the movable contact springs and the armature, and forming the armature unit by cutting boundary portions between the connecting bars and the movable contact springs and non-magnetizing plate.

In a production process according to the present invention, the non-magnetizing plate is formed on the hoop member, and simultaneously the hoop member is connected to a plurality of movable contact springs, and accordingly, processes for forming the non-magnetizing plate and preparation of the non-magnetizing plate as a separate part are respectively not required. Concurrently, by joining the non-magnetizing plate and the armature, the armature is formed integrally with the movable contact springs, and as a result of insert-molding, a unitary formation is provided on both the movable contact springs and the armature thereby enabling a simultaneous supply thereof to the die, and the realization of an automated production process.

BRIEF DESCRIPTION OF THE DRAWINGS

The present invention will be more clearly understood from the description as set forth below, with reference to the accompanying drawings wherein:

FIGS. 19A and 17B are other types of pivot arms having a flat end part.

DESCRIPTION OF THE PREFERRED EMBODIMENTS

Figure 1:
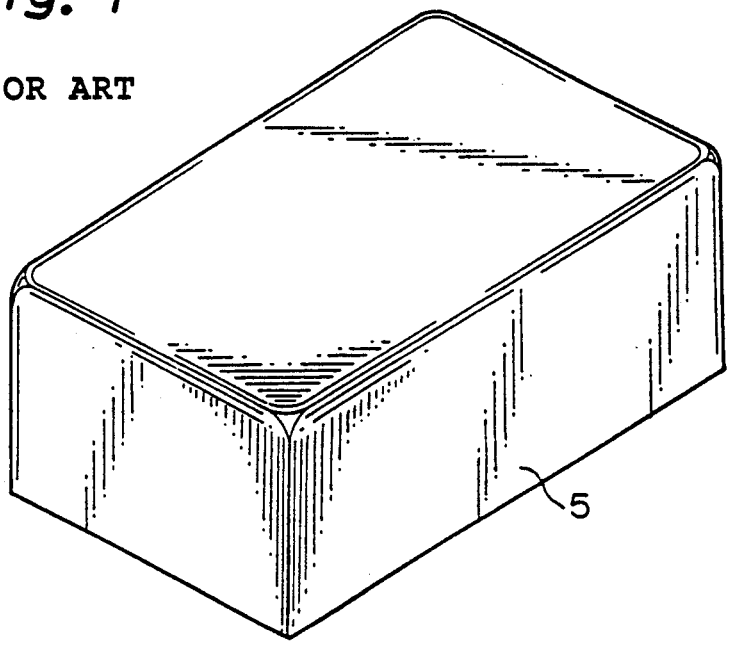
Fig. 1 PRIOR ART
FIG. 1 shows an enlarged perspective view of a conventional monostable seesaw balance type microminiature electromagnetic relay.
Figure 1:
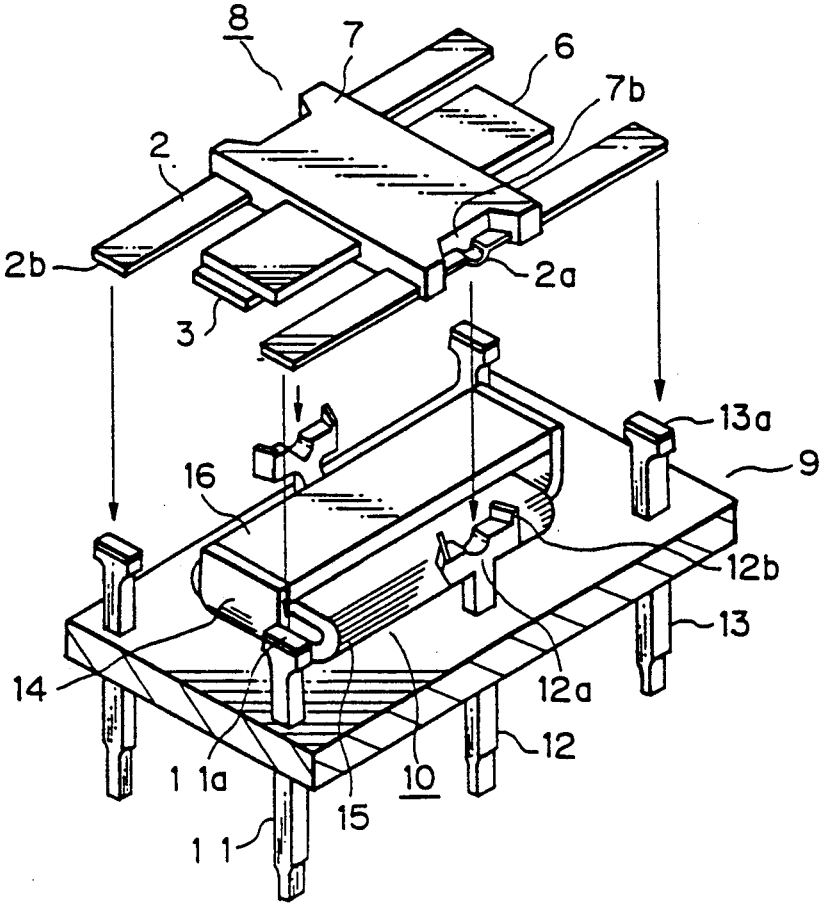
Fig. 1 PRIOR ART
Figure 2A:
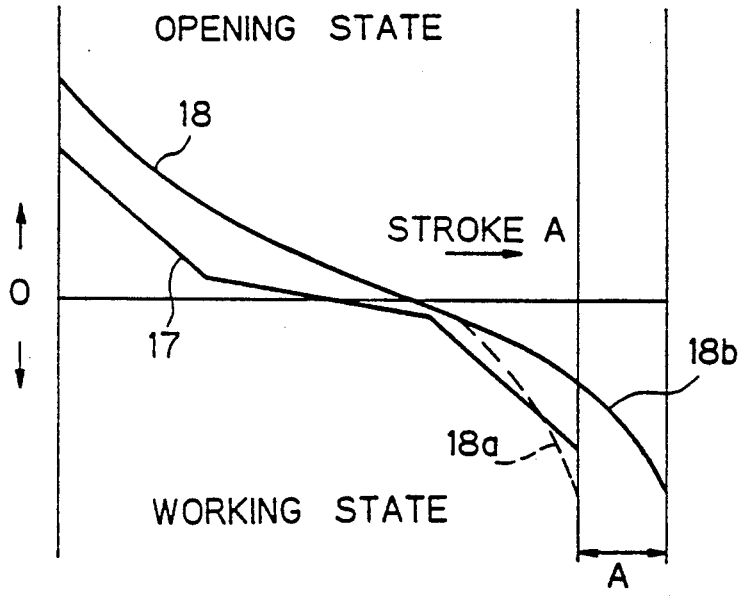
Fig. 2A PRIOR ART
FIG. 2A is an operational characteristic of the relay shown in FIG. 1.
Figure 2B:
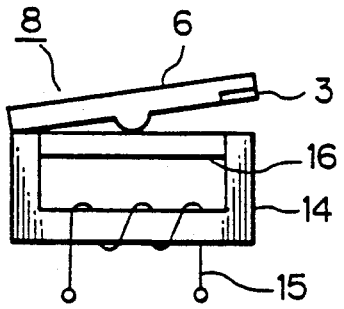
Fig. 2B PRIOR ART
FIG. 2B is a illustrative view of the operation of a non-magnetizing plate of the relay in FIG. 1 when a exciter coil is not energized.
Figure 2C:
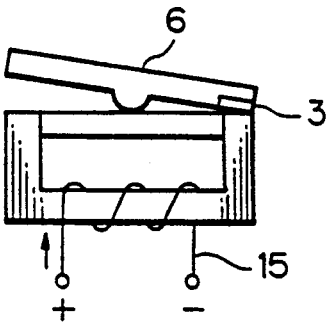
Fig. 2C PRIOR ART
FIG. 2C is a illustrative view of the operation of a non-magnetizing plate of the relay in FIG. 1 when a exciter coil is energized.
Figure 3A:
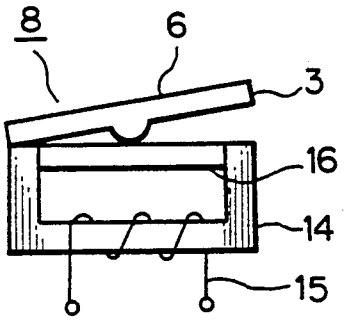
FIGS. 3A to 3D show the operation of an armature of a bistable seesaw balance type microminiature electromagnetic relay having no non-magnetizing plate on the armature.
Figure 3B:
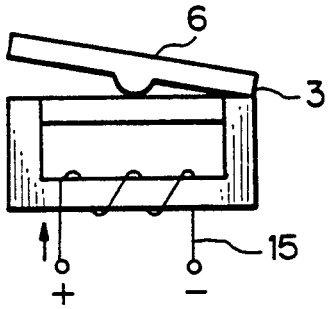
Figure 3C:
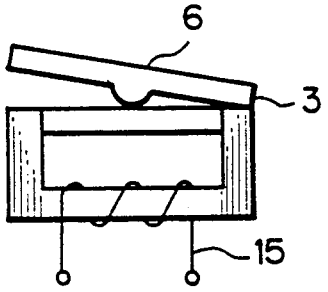
Figure 3D:
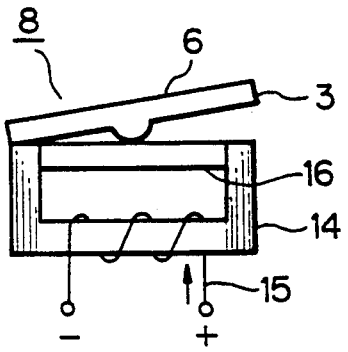
Figure 4:
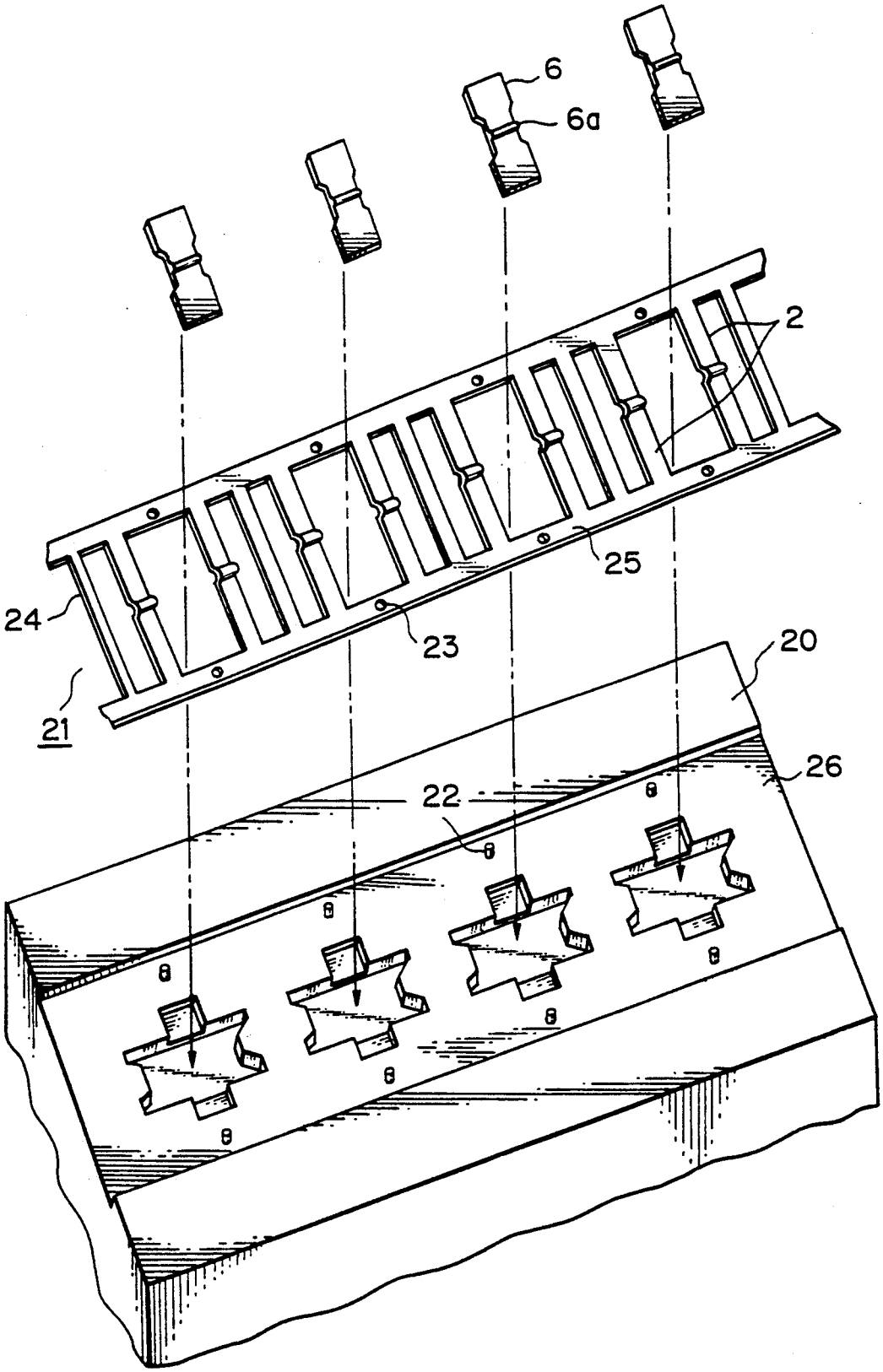
FIG. 4 is a perspective view illustrating a conventional production of an armature unit on a hoop member by using a mold.
Figure 5:
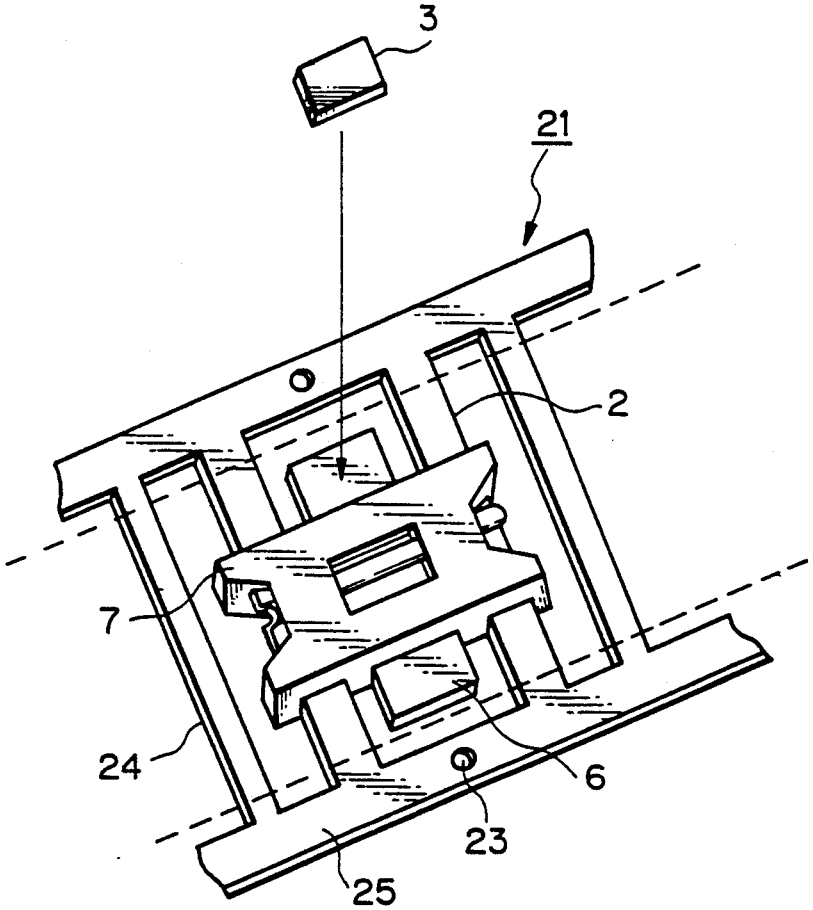
FIG. 5 is a perspective view of a hoop member and a non-magnetizing plate after an insert-mold process illustrating a conventional method of production.
Figure 6:
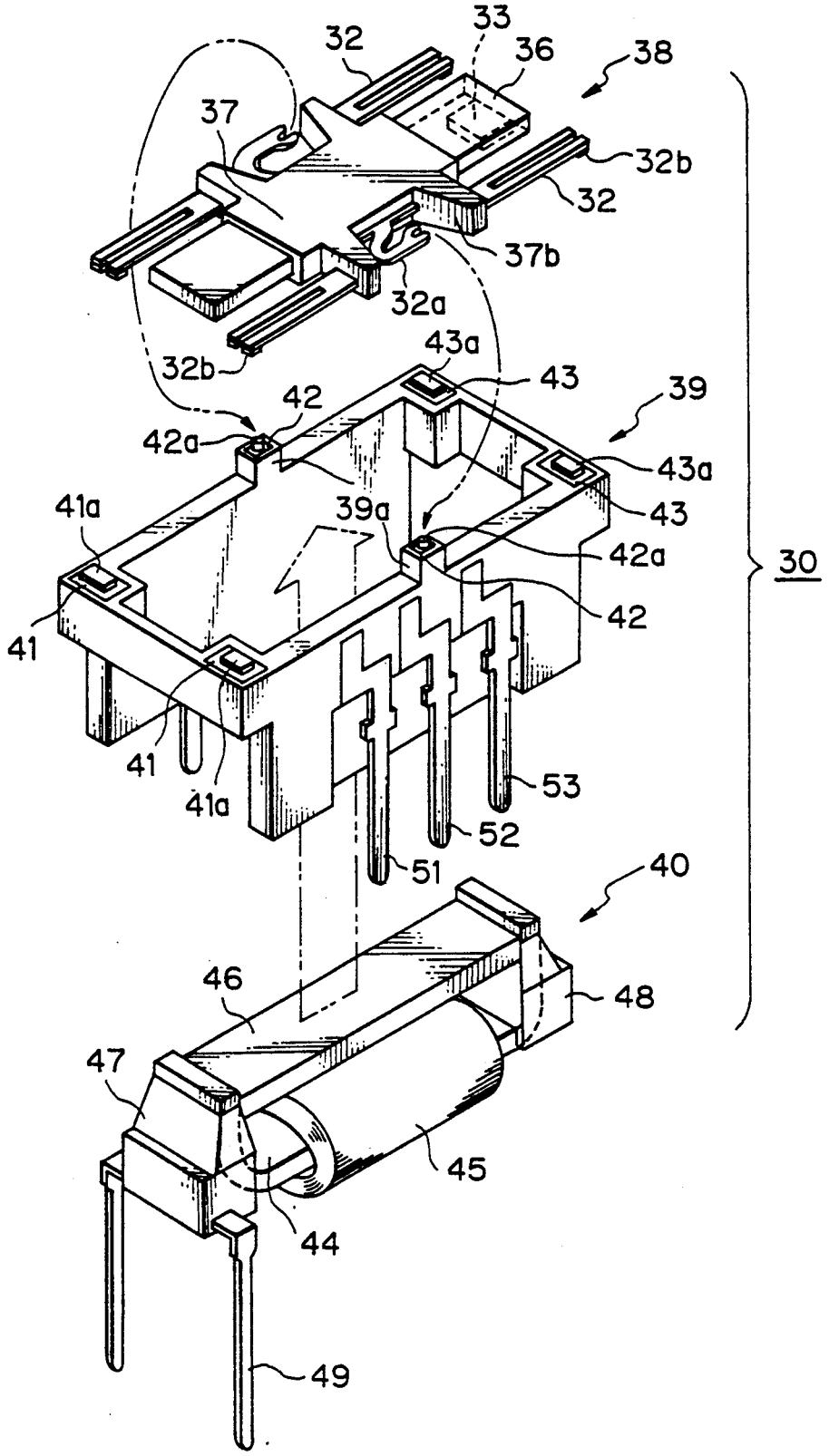
FIG. 6 shows an enlarged perspective view of a seesaw type microminiature electromagnetic relay according to one embodiment of the present invention.
Figure 7:
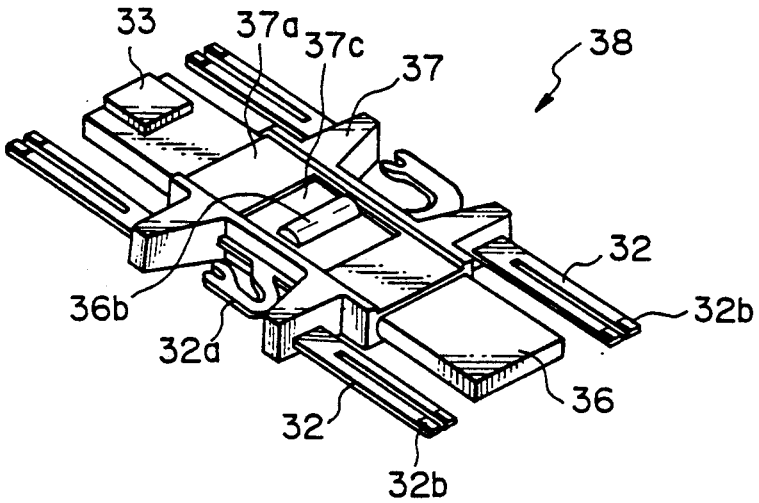
FIG. 7 is a perspective bottom view of a monostable type armature according to one embodiment of the present invention.

FIG. 6 shows an enlarged perspective view of a seesaw balance type microminiature electromagnetic relay according to one embodiment of the present invention. And FIG. 7 shows an perspective bottom view of a armature unit.

In FIG. 6, the electromagnetic relay 30 is comprised of, in broad classification, an armature unit 38, a hollow substrate unit 39, and an electromagnet unit 40. The armature unit 38 is mounted onto common terminal pins 42 provided on the substrate unit 39 and the electromagnet unit 40 is provided in the hollow substrate unit 39 and under the armature unit 38.

The armature unit 38 is comprised of two movable contact springs 32 having a pivot arm 32*a* formed at the center thereof and contacts 32*b* formed a both respective bifurcated ends thereof, an armature 36 having a non-magnetizing plate 33 on one end of the bottom face thereof, and an insert-molded insulator 37 having notches 37*b* for exposing the pivot arm 32*a* of the movable contact springs 32. The pivot arm 32*a* is U-shaped and the free edge thereof is bifurcated. As shown in FIG. 7, the insulator 37 has a shallow groove 37*a* on a bottom face, and a recess 37*c* in the groove 37*a* for exposing the protrusions 36*b* of the armature 36.

The substrate unit 39 is hollow and there is provided a plurality of terminals 41 to 43 on the upper edge thereof. These terminals 41 to 43 are electrically connected to pins 51 to 53 respectively provided on the side outer face of the hollow substrate unit 39 for connecting to the external. Terminals 41 and 43 each have a fixed contact 41*a* and 43*a* and terminal 42 has a contact pin 42*a*, and a position of the common terminal 42 is higher than the other terminals 41 and 43 by a projection part 39*a* of the substrate unit 39.

The electromagnet unit 40 is comprised of a U-shape yoke 44, an exciter coil 45 wound on the yoke 44, and a flat shape permanent magnet 46 that is fixed to join both ends of the yoke 44. Both sides of the yoke 44 are molded by the plastic to become end blocks 47 and 48. Two terminal pins 49 electrically connected to the start and the end of the exciter coil 45 respectively are provided on the side of the end block 47.

Figure 8:
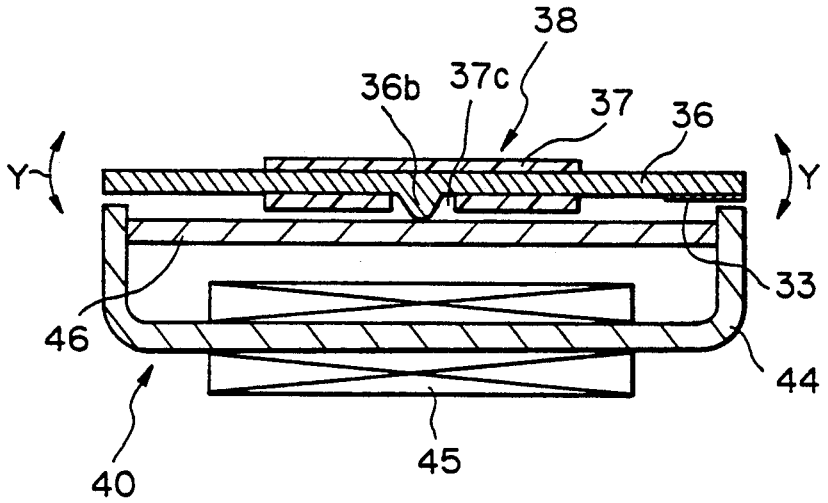
FIG. 8 is a explanatory sectional view showing a relationship between an armature and an exciter coil in the relay according to the present invention.

Because the free edge of the pivot arm 32*a* engages with the common terminal 42 that is lifted by the projection part 39*a* of the substrate unit 39, the armature unit 38 can be pivotally disposed on the substrate unit 39. As shown in FIG. 8, the protrusion 36*b* of the armature 36 contacts a surface of the permanent magnet 46 to be set so that the non-magnetizing plate 33 confronts one-side end of the yoke 44.

In such an electromagnetic relay 30, switching of the contact terminal i.e., switching from the connection of the common pin 52 and the pin 51 to the connection of the common pin 52 and the pin 53 or vice versa is executed by a pivotal movement of the armature unit 38 in a seesaw manner Y by varying the magnetic flux by energizing the exciter coil 45 as shown in FIG. 8.

A method of producing the electromagnetic relay 30 will be described with reference to FIGS. 9 to 13 as follows.

Figure 9:
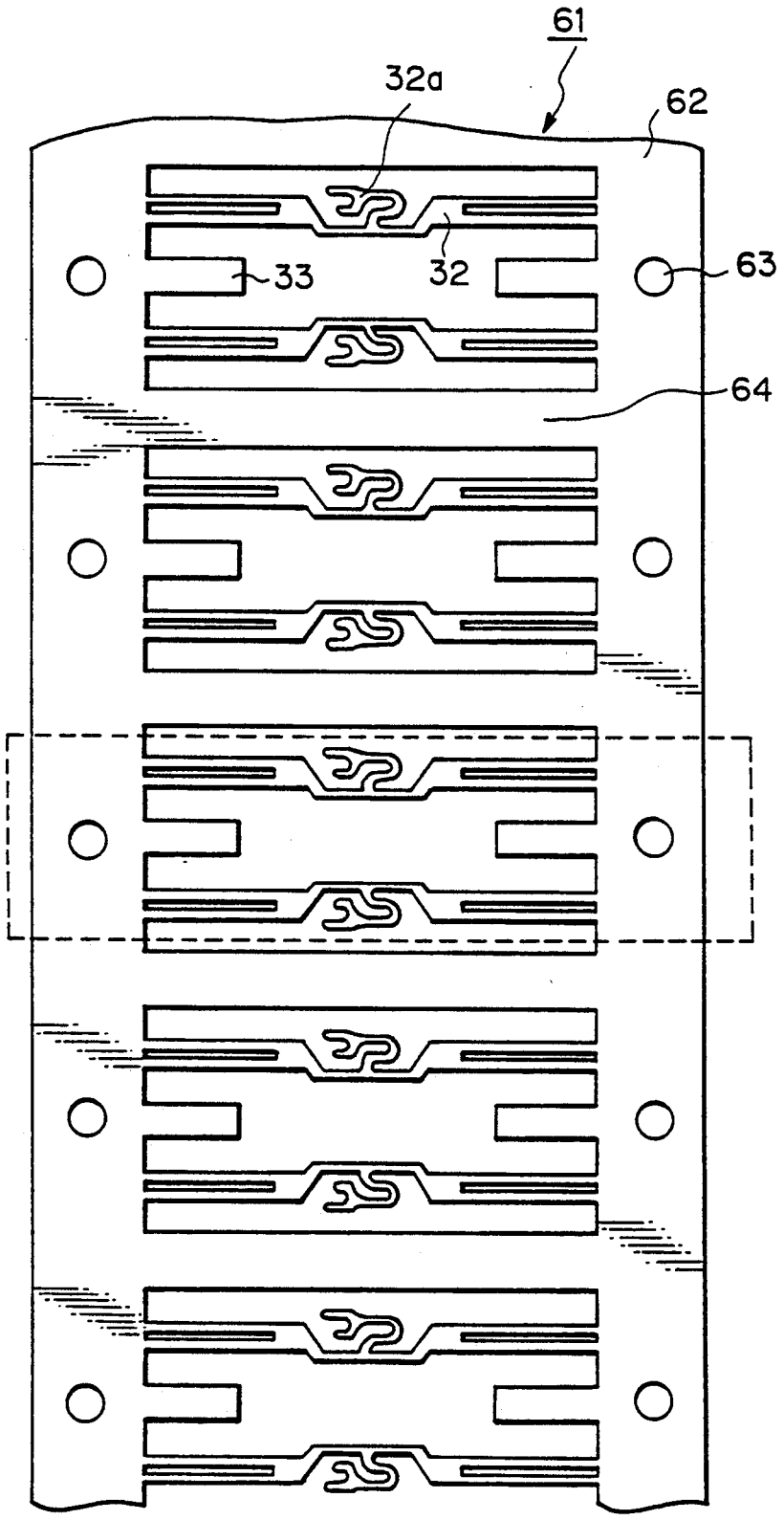
FIG. 9 is a plain view of a hoop member according to the first step of the present invention.

FIG. 9 is a plain view of a hoop member 61 formed on the first step of producing the electromagnetic relay 30 according to the present invention. In FIG. 9, the same members explained before are given the same reference numerals, so that reference numerals 32 denotes a movable contact spring, 32*a* denotes a pivot arm extended from the center part of the movable contact spring 32, and 36 denotes a non-magnetizing plate. Further, both ends of the movable contact spring 32 and one end of the non-magnetizing plate 36 are connected by a connecting bar 62 having positioning holes 63 and reinforcement pieces 64 in the same intervals.

In FIG. 9, members surrounded by a dotted line is a group used for one electromagnetic relay 30, i.e., a pair of movable contact springs 32 each having a pivot arm 32*a* and two non-magnetizing plates 36 are used for one electromagnetic relay 30. The hoop member 61 is formed in an integrated configuration of a plurality of groups by a press blanking procedure. The non-magnetizing plate 36 formed as a protrusion plate from the connection bar 62 confronting each other is used for supporting an armature in the latter processing. Further, the positioning holes 63 in the connection bar are provided for positioning the hoop member in a die in the latter processing.

Figure 10A:
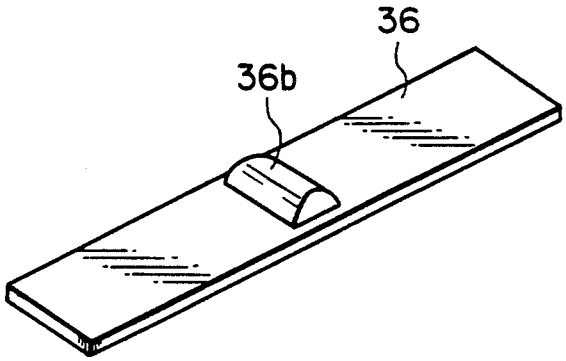
FIG. 10A is a perspective view of a monostable type armature according to the present invention.

FIG. 10A is a perspective view of a monostable type armature 36 according to the present invention. The armature 36 is formed on its center with a protrusion 36*a* by a press blanking procedure. The protrusion 36*b* is formed on the back side of the armature 36 to contact a surface of the permanent magnet 46 as explained before.

Figure 10B:
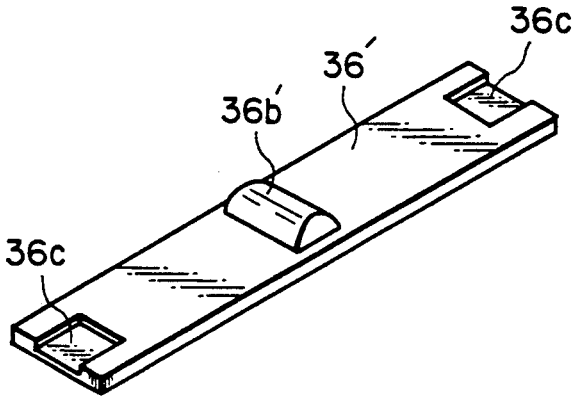
FIG. 10B is a perspective view of a bistable type armature according to the present invention.

FIG. 10B is a perspective view of a bistable type armature 36' according to the present invention. The protrusion 36*b*' is also formed on the back side of the armature 36' to contact a surface of the permanent magnet 46 as explained before. Further, groove 36*c* is provided on both ends of the back side for receiving the non-magnetizing plate 36'. The depth of the grooves 36c is larger than or equal to the thickness of the hoop member 61, for making the surface of the back side of the armature 36' flat after the non-magnetizing plate 33 is received in the grooves 36c.

Figure 11:
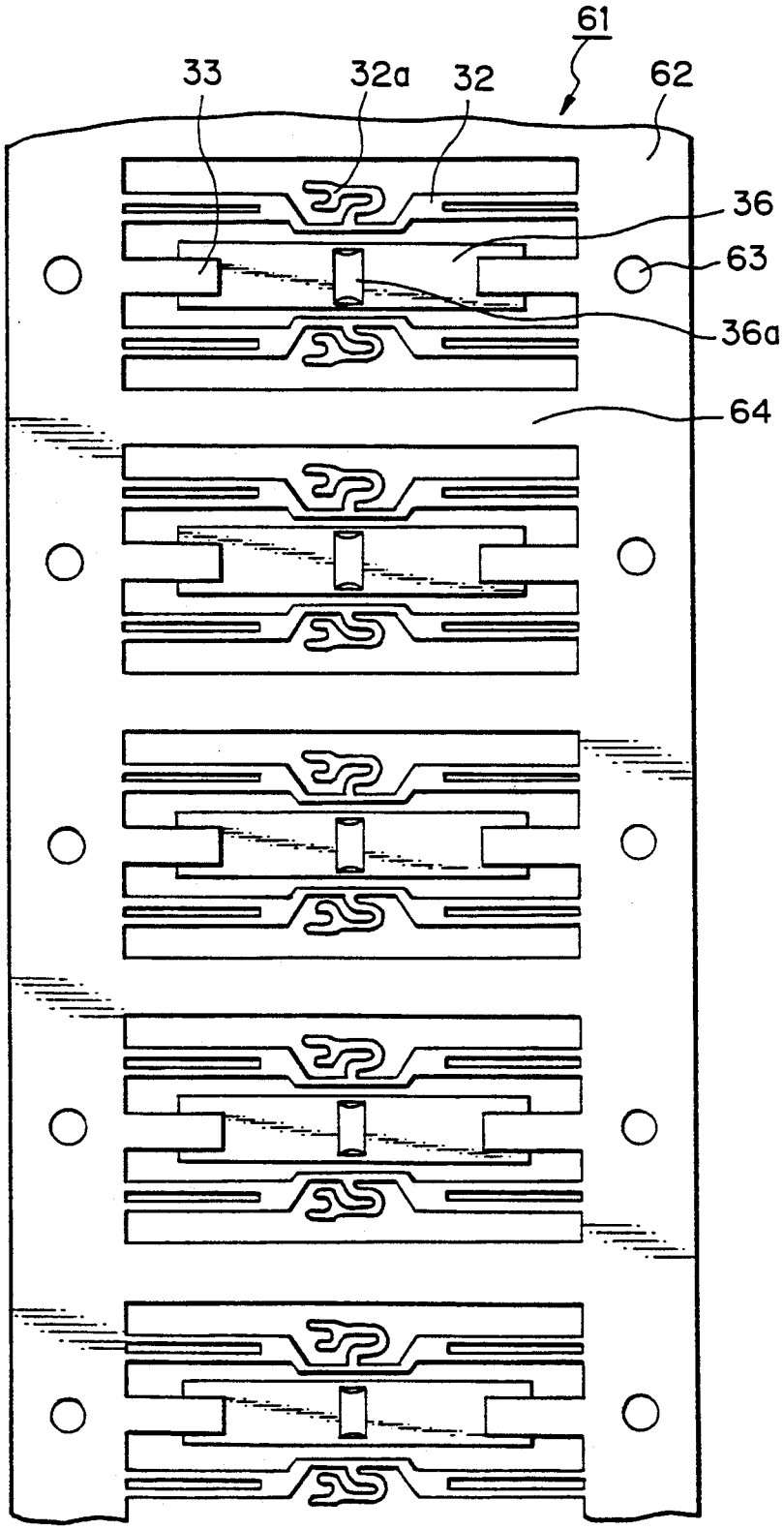
FIG. 11 is a plain view of the armature joined hoop member according to the second step of the present invention.

FIG. 11 shows the second step where an armature 36 is securely joined with the hoop member 61. The armature 36 for a monostable seesaw balance type microminiature electromagnetic relay is welded on only one end thereof, as shown by X in FIG. 11, to the non-magnetizing plate 33. The other end of the armature 36 is then supported by the non-magnetizing plate 33. However, both ends of the armature 36' for a bistable seesaw balance type microminiature electromagnetic relay are received in grooves 36c and both ends are welded to the non-magnetizing plate 33. The process to join the armature 36 or 36' with the hoop member can be executed by an automatic device such as an industrial robot outside of a die.

Figure 12:
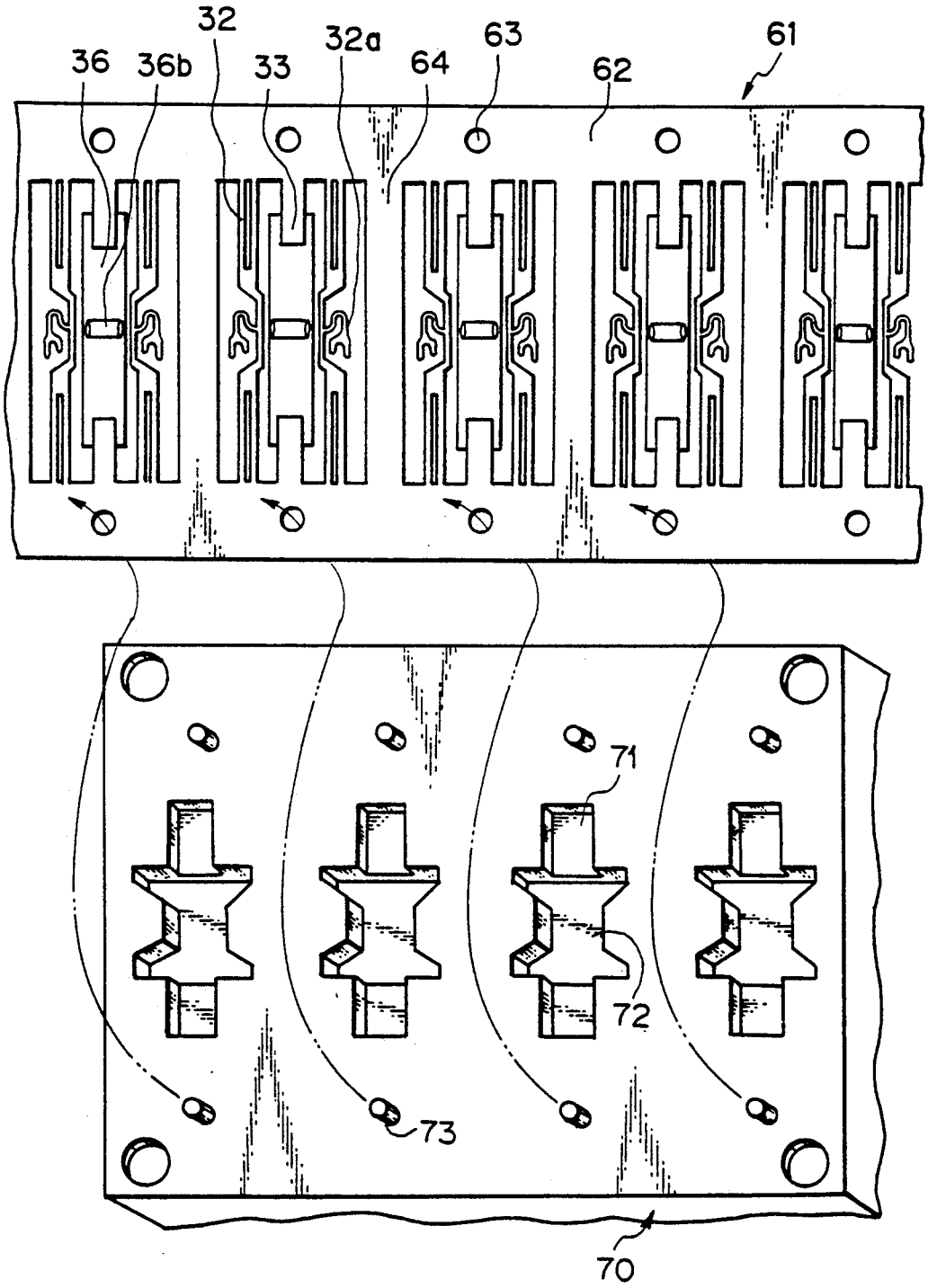
FIG. 12 is a perspective view illustrating the production of an armature unit on the armature joined hoop member by using a mold according to the third step of the present invention.

FIG. 12 shows the third step where the armature joined hoop member 61 is insert-molded by using a die 70. In FIG. 12, only a lower die 70 is disclosed but there is an upper die that is not shown. And in this embodiment, four armature units are made by the die 70 at one time. The die 70 has a shallow ditch 71 for receiving the edge part of the non-magnetizing plate 33, a deep ditch 72 for making an insulator by insert-molding, and a pin 73 for inserting into the positioning hole 63 on the connecting bar 62 of the hoop member 61.

The hoop member 61 that is integrally formed with the armature 36 or 36' is transferred to the die 70 by an automatic device such as an industrial robot and positioned on the die 70 by inserting the pin 73 thereon into the positioning hole 63 on the hoop member 61. Then the upper die (not shown) is folded on the die 70 and flowing insulating members like plastics are inserted into the deep ditch 72 to mold an insulator 37 as shown in FIG. 6, 7, and 13 that may cover the movable contact springs 32 and the armature 36.

The insulator 37 is insert-molded to form notches 37a, each of a trapezoidal shape, for exposing the pivot arm 32a of the movable contact springs 32, and a recess 37b for exposing the protrusion 36a of the armature 36 as shown in FIG. 6 and 7.

Figure 13:
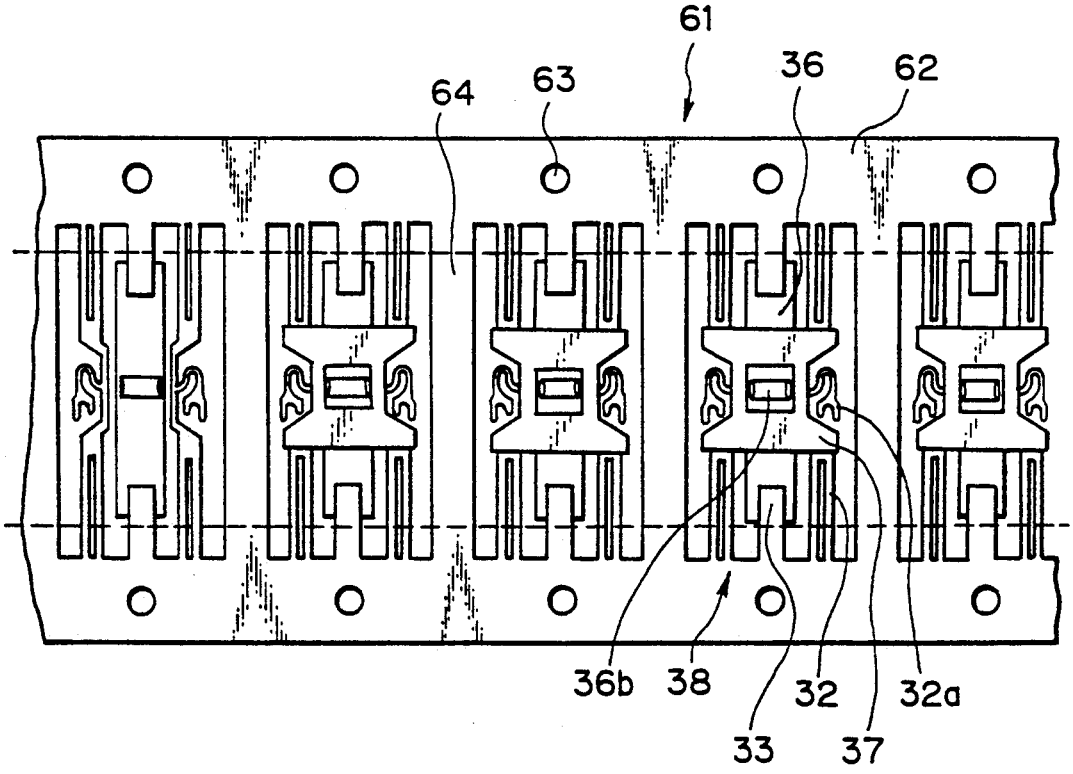
FIG. 13 is a plain view of armature units on a hoop member after an insert-mold process according to fourth step of the present invention.

FIG. 13 shows the fourth step where the armature joined hoop member 61 is insert-molded by using a die 70. In this step, a portion indicated by dotted lines in FIG. 13 is cut by dicing or the like for separating the movable contact springs 32 and the non-magnetizing plate 33 from the connecting bars 62. When the relay is the monostable type, one of the non-magnetizing plates 33 are disposed, but when the relay is the bistable type, none of the non-magnetizing plates 33 are disposed.

Finally, in the fifth step, movable contacts 32b are formed at both respective ends of the movable contact springs 32 by gold plating and the like as shown in FIGS. 6 and 7.

In the above-described method of producing the seesaw balance type microminiature electromagnetic relay 30, in the insert mold operation, the movable contact springs 32 and the armature 36 are supplied to the die 70 as one body by the industrial robot and supported therein at the same time. Accordingly, the structure of the industrial robot becomes simple. Further, the non-magnetizing plate extended from the connecting bar of the hoop member is welded on one or both side ends of the armature 36 in the insert-molding procedure according to the present invention, a troublesome processing for mounting such a small non-magnetic plate is omitted, and automatic operation becomes simpler and the cost of the industrial robot is reduced.

The seesaw balance type microminiature electromagnetic relay 30 produced by the above-described method requires improved characteristics and productivity by ensuring and stabilizing a junction at the junction area even in a smaller junction area between the pivot arm 32a extended from the movable contact spring 32 and the terminal pin 42.

In the field of electronics and computer systems in recent years, in order to meet miniaturization requirements for devices, electromagnetic relays to be mounted on circuit substrates and the like have also been developed for miniaturization. This means that respective members constituting the electromagnetic relay 30 are now also in the stage of development.

To miniaturize, for example, electromagnetic relay 30, in which the pivot arm 32a and the common terminal pin 42 to be electrically connected thereto must be mutually joined, it is difficult to obtain an area sufficient to join the pivot arm 32a and the common terminal pin 42, thereby resulting in a weak point in the electromagnetic relay 30 and causing unstable junction areas. Therefore, a countermeasure for solving the foregoing problem is now in demand.

Accordingly, the structure of the pivot arm 32a as produced in the above-described method and having a sufficient joining force will be explained hereinafter, and other variations of the pivot arm 32a are also explained.

Figure 14A:
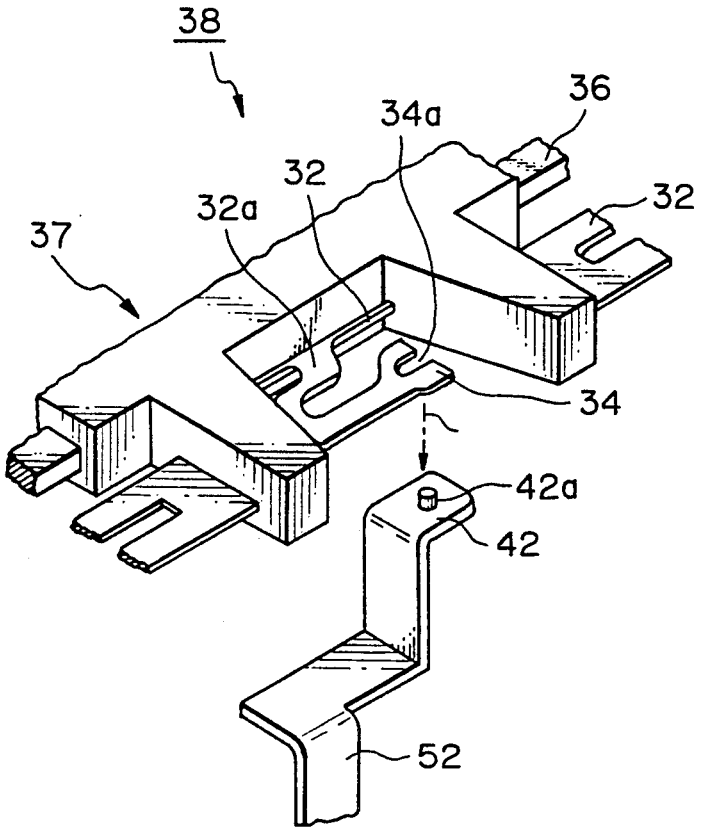
FIG. 14A is a perspective view showing a part of an armature and a terminal pin on which a pivot arm of the armature is mounted according to the invention.

FIG. 14A is an essential constitutional view of the embodiment of the relay 30 before the pivot arm 32a and the common terminal pin 42 is joined according to the invention, where 32 is the movable contact spring, 32a is the pivot arm, 36 is the armature, 37 is the insert-molded insulator, 38 is the armature unit, 42 is the common terminal pin, and 42a is the contact pin. And FIG. 14B indicates the state after the pivot arm 32a and the common terminal pin 42 is joined.

Figure 14B:
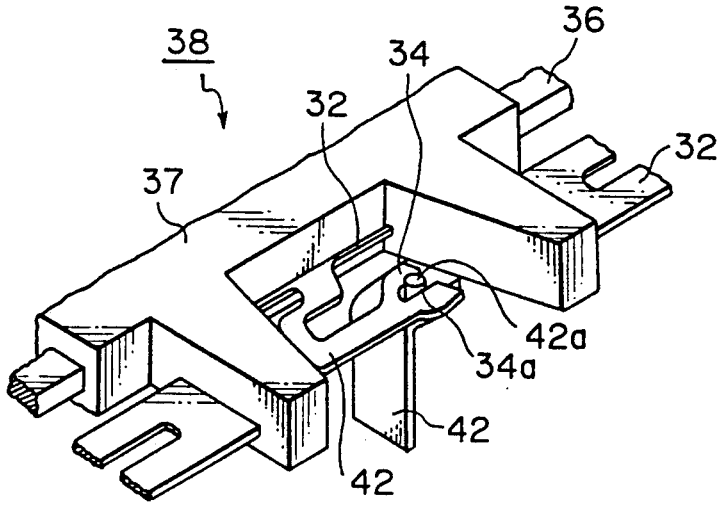
FIG. 14B is a perspective view of the same part as shown in FIG. 13 showing a pivot arm of the armature mounted on a terminal pin according to the invention.

As shown in FIG. 14A, the pivot arm 32a is extended from the the U-shaped movable contact spring 32 and the free edge 34 thereof is bifurcated by a U-shaped recess 34a. When the armature unit 38 is mounted on the substrate unit (not shown), the contact pin 42a of the common terminal 42 provided on the substrate unit is inserted into the U-shaped recess 34a as shown in FIG. 14B.

Figure 15A:
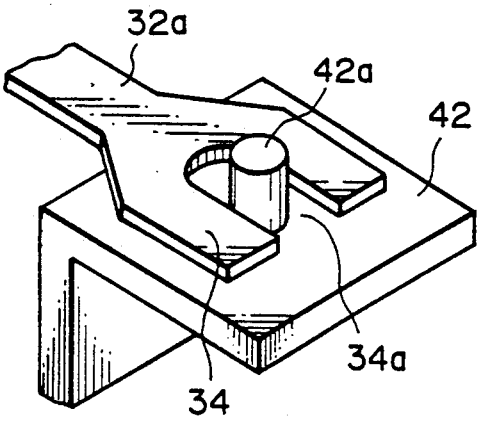
FIG. 15A is an enlarged perspective view of the pivot arm and the terminal pin.
Figure 15B:
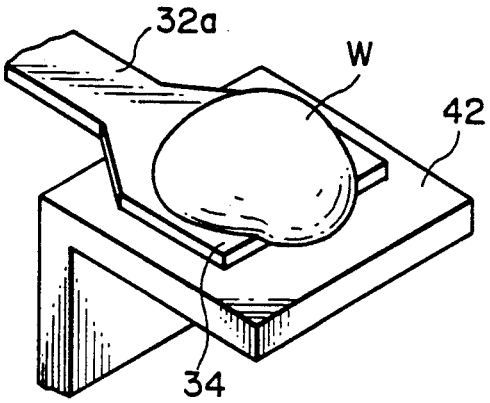
FIG. 15B is a perspective view of the same part as shown in FIG. 15A after the pivot arm and the terminal pin are welded.
Figure 16:
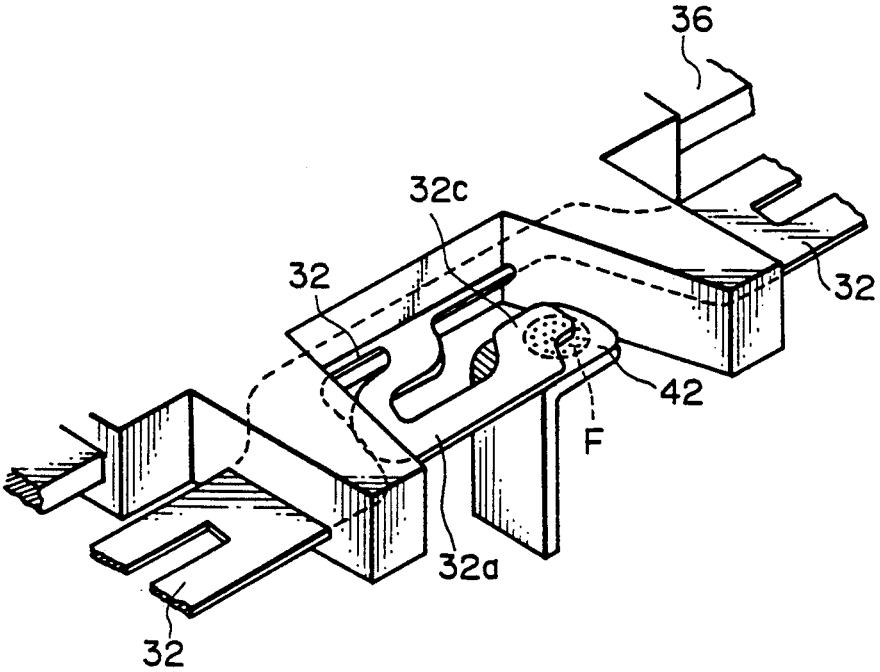
FIG. 16 is a perspective view of the same part as shown in FIG. 13 showing a conventional pivot arm of the armature welded on a terminal pin.

FIG. 15A is an enlarged perspective view showing the inserted condition of the contact pin 42a to the U-shaped recess 34a. After insertion of the contact pin 42a into the U-shaped recess 34a, the contact pin 42a and the free edge 34 of the pivot arm 32a are welded, as shown in FIG. 15B by the reference W. The weld W of the the contact pin 42a and the free edge 34 are three-dimensional so that this weld W has a sufficient joining force and is stronger than the conventional two-dimentional weld F as shown in FIG. 16, where a free edge 32c of the pivot arm 32a is flat and the common terminal 42 has no contact pin.

Figure 17A:
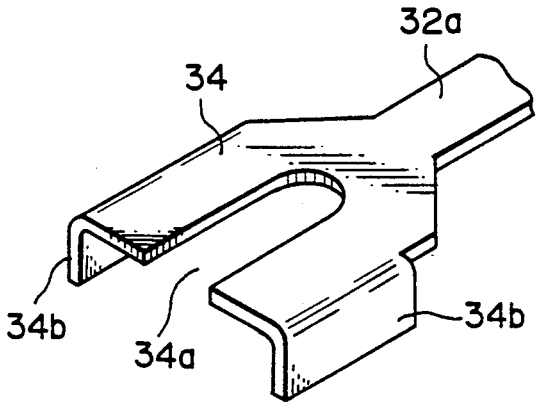
FIGS. 17A to 17C are other types of pivot arms having a biburcated end.
Figure 17B:
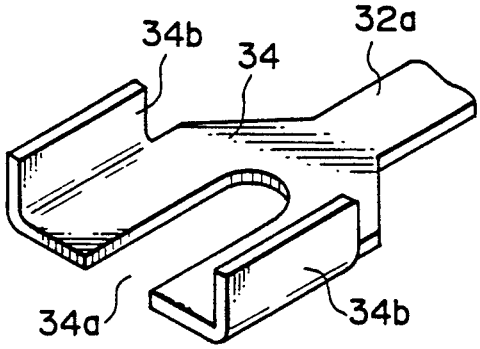
Figure 17C:
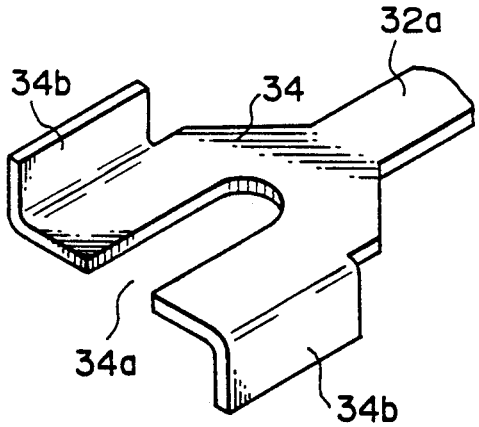

FIGS. 17A to 17C are variations of the free edge 34 of the pivot arm 32a having the U-shaped recess 34a. The free edge 34 in FIG. 17A to 17C has two bend plates 34b on both sides thereof and the bended direction of the two bend plates 34b is different, respectively, i.e., two bend plates 34b are bended in a lower direction in FIG. 17A, bended in an upper direction in FIG. 17B, and two bend plates 34*b* are bended in upper and lower directions respectively in FIG. 17C. When the bend plates 34*b* are provided on both sides of the free edge 34 of the pivot arm 32*a*, the free edge 34 is strongly against the stress in a vertical direction.

Figure 18A:
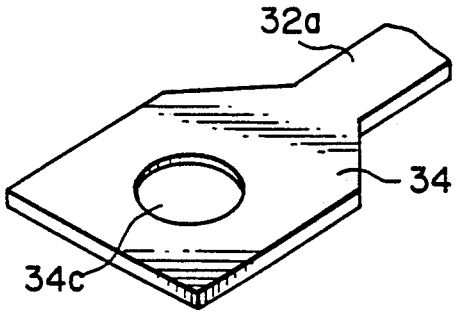
FIGS. 18A to 18D are other types of pivot arms having a hole on the end part.
Figure 18B:
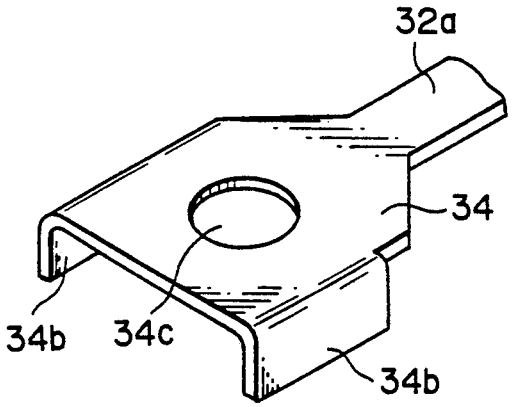
Figure 18C:
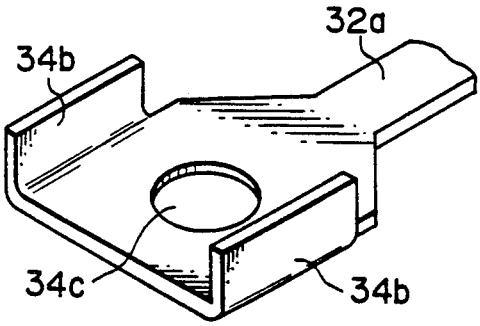
Figure 18D:
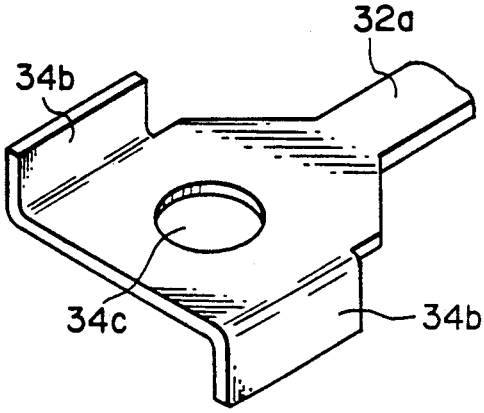

FIG. 18A is an other embodiment of the free edge 34 of the pivot arm 32*a*. The free edge 34 of this embodiment has a hole 34*c* instead of a U-shaped recess 34*a*. The diameter of the hole 34*c* is equal to or larger than the diameter of the contact pin 42*a*. FIGS. 18B to 18D are variations of the free edge 34 of the pivot arm 32*a* having the hole 34*c*. The free edge 34 in FIG. 18A to 18C has two bend plates 34*b* on both sides thereof and the bended direction of the two bend plates 34*b* is different, respectively, i.e., two bend plates 34*b* are bended in a lower direction in FIG. 18B, bended in an upper direction in FIG. 18C, and two bend plates 34*b* are bended upper and lower direction respectively in FIG. 18D. When the bend plates 34*b* are provided on both sides of the free edge 34 of the pivot arm 32*a*, the free edge 34 is strongly against the stress in a vertical direction.

Figure 19A:
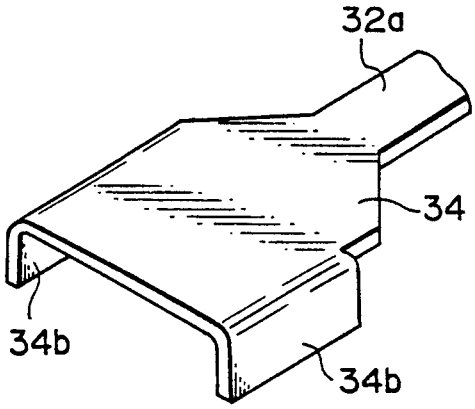
Figure 19B:
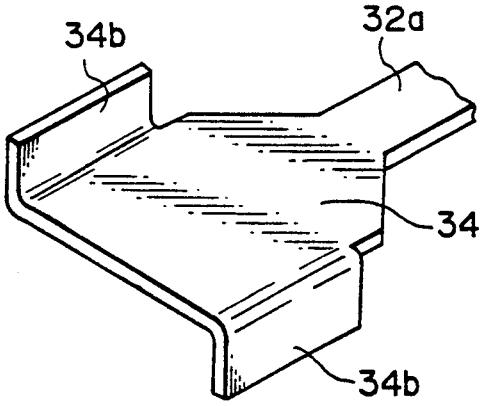

FIGS. 19A and 19B are other embodiments of the free edge 34 of the pivot arm 32*a*. The free edge 34 of this embodiment does not have a hole 34*c* or a U-shaped recess 34*a*. The free edge 34 in FIG. 19A and 19B has two bend plates 34*b* on both sides thereof and the bended direction of the two bend plates 34*b* is different, respectively, i.e., two bend plates 34*b* are bended in a lower direction in FIG. 19A, and two bend plates 34*b* are bended in an upper and lower direction respectively in FIG. 19B.

As hereinbefore fully described, in a production process according to the present invention, the non-magnetizing plate is formed on the hoop member at the same time that the hoop member is connected to a plurality of movable contact springs, and accordingly, processes for forming a non-magnetizing plate and the preparation of a non-magnetizing plate separately are not required. Concurrently, by joining the non-magnetizing plate and the armature, the armature is formed integrally with the movable contact springs, and as a result of insert-molding, a unitary formation is provided on both the movable contact springs and the armature, thus enabling a simultaneous supply thereof to the die, and therefore an automated production process can be attained at a lower cost.

Further, as hereinbefore fully described, according to the invention, there can be proposed an electromagnetic relay that has improved characteristics and productivity by ensuring and stabilizing a junction state at the junction area even in a small junction area between the movable contact spring and the terminal pin.

What is claimed is:

1. An electromagnetic relay including an armature unit consisting of two movable contact springs and having a pivot arm formed at the center thereof and contacts formed at the ends thereof, an armature having a protrusion on the back side thereof for pivotal movement, and an insert-molded insulator, a substrate unit consisting of a terminal for mounting the pivot arm electrically connected to a terminal pin, a pair of switching terminals having fixed contacts for connecting the contacts electrically connected to the terminal pins, and an electromagnet unit consisting of a yoke, an exciter coil wound on the yoke having a start and an end, a flat shaped permanent magnet provided between the ends of the yoke, and two terminal pins electrically connected to the start and the end of the exciter coil, respectively, characterized in that, the pivot arm extending from the center part of the movable contact spring is U-shaped and a positioning member is provided at the free edge thereof or at the common terminal for mounting the pivot arm.

2. An electromagnetic relay as set forth in claim 1, wherein the positioning member is U-shaped recess at the free edge and a contact pin at the common terminal.

3. An electromagnetic relay as set forth in claim 2, wherein both sides of the free edge are bent upward or downward.

4. An electromagnetic relay as set forth in claim 1, wherein the positioning member is a hole provided at the center part of the free edge and a contact pin at the common terminal.

5. An electromagnetic relay as set forth in claim 4, wherein both sides of the free edge are bent upward or downward.

6. An electromagnetic relay as set forth in claim 1, wherein the positioning member is a bend plate provided at both sides of the free edge bent upward or downward.

* * * * *